US005231669A

United States Patent [19]

Galand et al.

[11] Patent Number: 5,231,669

[45] Date of Patent: Jul. 27, 1993

[54] LOW BIT RATE VOICE CODING METHOD AND DEVICE

[75] Inventors: Claude Galand, Cagnes sur Mer; Michele Rosso, Nice, both of France

[73] Assignee: International Business Machines Corporation, Armonk, N.Y.

[21] Appl. No.: 375,303

[22] Filed: Jul. 3, 1989

[30] Foreign Application Priority Data

Jul. 18, 1988 [EP] European Pat. Off. ..... 88480017.8

[51] Int. Cl.[5] ..... Q10L 5/00

[52] U.S. Cl. ..... 381/36; 381/38

[58] Field of Search ..... 381/29-38; 364/513.5; 375/122

[56] References Cited

U.S. PATENT DOCUMENTS 4,771,465 9/1988 Bronson et al. ..... 381/38

4,811,398 3/1989 Copperi et al. ..... 381/36

*Primary Examiner*—Emanuel S. Kemeny

*Attorney, Agent, or Firm*—Edward H. Duffield

[57] ABSTRACT

In a voice coding system, the baseband or residual signal is encoded at a lower rate by finding a best estimate at a lower rate. The voice terminal signal x(n) is split into a low-pass filtered band signal y1(n) and a high-pass filtered band signal y2(n). Both y1(n) and y2(n) signals are coded into lower-rate sub-sequences of samples x1(n), x2(n) and x3(n), x4(n) respectively. The sequence of samples to be representative of x(n) is selected among x1(n), x2(n), x3(n) and x4(n) for being the closest to x(n).

6 Claims, 12 Drawing Sheets

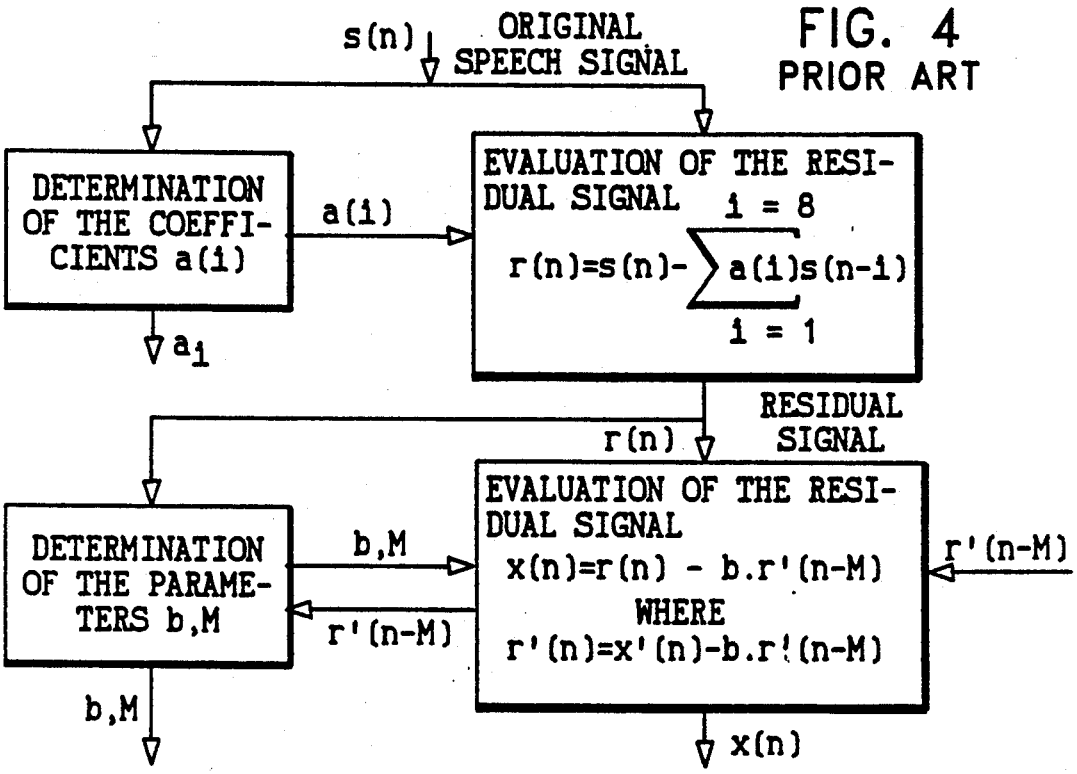
FIG. 4
PRIOR ART
FIG. 5
PRIOR ART
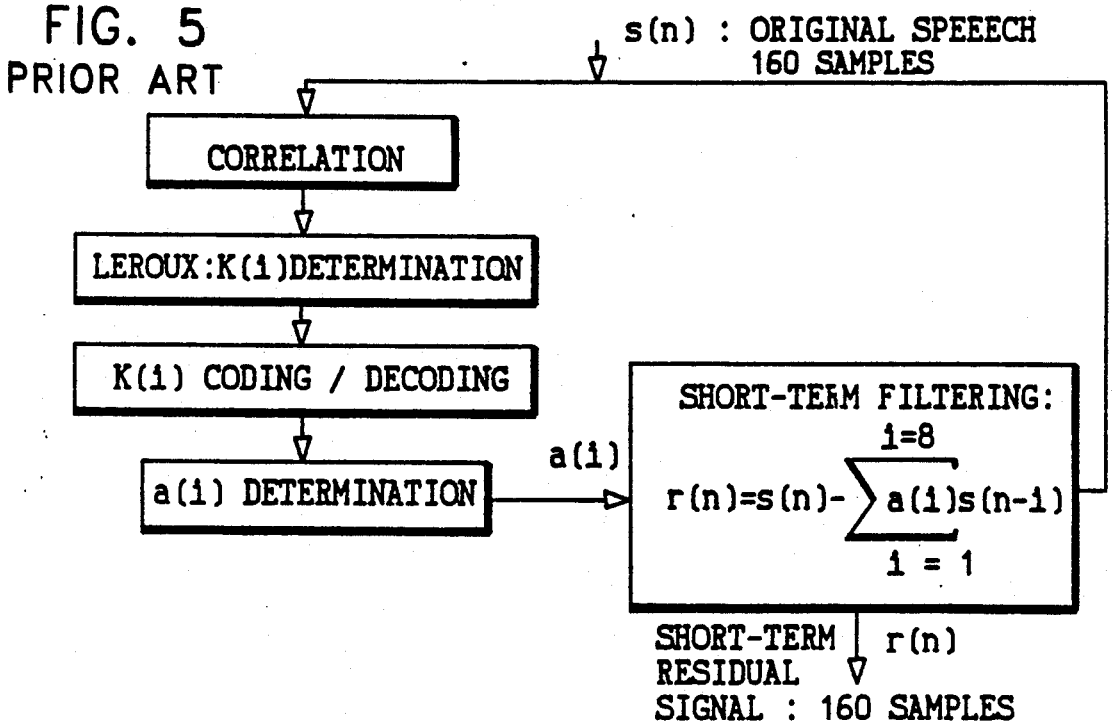

LOW BIT RATE VOICE CODING METHOD AND DEVICE

This is a method and device for improving low bit rate coding of signals provided by voice terminals. It applies more particularly to coding schemes including band limiting the original voice terminal derived signal, sub-sampling and coding said band limited signal, and for subsequently spreading said band limited bandwidth back to original full-band during voice synthesis operations.

More particularly, the invention deals with a method for low rate encoding a sampled voice terminal derived signal, including splitting said signal bandwidth into at least two adjacent sub bands, subsampling and coding the contents of each sub band, then up sampling said coded sub band contents back, comparing each up sampled sub band contents to the original voice terminal derived signal for selecting the coded sub band contents closest to said original to be representative thereof.

BACKGROUND OF THE INVENTION

Low bit rate voice coding has been performed through use of signal bandwidth limitation, whereby the original voice signal is first filtered to derive therefrom a base-band signal which, according to Nyquist theory could be sampled efficiently at a rate lower than the rate used for the original full-band signal. Said limited bandwidth may therefore be coded at low bit rate.

Subsequent decoding and conversion back to the original signal is achieved by spreading the base-band over a broader bandwidth and up-rating the sampling rate.

Traditionally, the above mentioned filtering is achieved with a low pass filter with a cut-off frequency at about 1300 Hertz, i.e. large enough to include any speaker's pitch frequency. Said low pass filtering is either operated directly over the signal provided by the voice terminal, or operated over a decorrelated residual derived signal from said voice terminal signal. Both cases may be defined as dealing with voice terminal derived signals.

In some applications, e.g. related to telephony, the network over which the coded voice signal is to be transmitted, is also used to carry non voice originated signals, like for instance busy tones or other service tones. Said tones are made of a pure sinewave which might be at a frequency higher than the low-pass filter cut-off frequency.

The conventional base-band coding operations would then lead to loss of tones, or even worse, to dramatic tone distortions which could affect the whole network operation.

OBJECT OF THE INVENTION

One object of the invention is to provide an improved rate coding method for voice terminal derived signals, which method enables efficiently coding tones. These and other objects, advantages and features of the present invention will become more readily apparent from the following specification when taken in conjunction with the drawings.

BRIEF DESCRIPTION OF THE DRAWINGS

FIGS. 3-6 are flow charts for implementing block functions of the devices of FIGS. 1 and 2.

FIG. 14 is a block diagram of another embodiment of the invention.

DESCRIPTION OF THE PREFERRED EMBODIMENT

As already mentioned, the invention applies to different base band voice coding schemes.

Several base band coders to which the invention would fit nicely, are known, among which one may cite the Voice Excited Predictive Coder (VEPC), and the Regular Pulse Excited (RPE) coder.

For references to the VEPC, one may cite:

1. The IBM Journal of Research and Development, Vol. 29, No. 2, March 1985, pp. 147-157.
2. The Record of the 1978 IEEE International Conference on Acoustics, Speech and Signal Processing, pp. 307-311.
3. The European Patent 0,002,998 to this Applicant.

VEPC coding involves sampling (at 8 kHz), the original voice signal limited to conventional telephone bandwidth, PCM encoding said sampled signal and then recoding the signal into auto-correlation parameters, high band energy data and a low band signal to be recoded/quantized. In some instances the process involves decorrelating the PCM coded signal into a residual signal prior to performing the low band limiting operations. But in any case one may consider that recoding/quantizing, i.e. low rate coding, is to be performed over a voice terminal derived signal.

For references on RPE, one may refer to:

1. The article "Regular Pulse Excitation—A novel Approach to Effective and Efficient Multipulse Coding of Speech", published by Peter Kroon et al in IEEE Transactions on Acoustics, Speech and Signal Processing, Vol. ASSP-34, No. 5, October 1986, p. 1054 and following.
2. ICASSP 88, wherein further improvement was achieved by including the RPE coder within a feedback loop performing Long Term Prediction (LTP) operations on the signal to be submitted to RPE processing.
3. "Speech Codec for the European Mobile Radiosystem"; by P. Vary, K. Holling, R. Holmann, R. Sluyter, C. Galand and M. Rosso, in the Proceedings of ICASSP 1988, Vol. 1, pp. 227-230.

Eventhough applicable to any base-band oriented coding schemes, the invention fits nicely to RPE/LTP coding and a detailed implementation of such a coder will be described hereunder.

But in any case one should note that whichever be the type of coder used, synthesis from a base band coded signal back to original signal includes processing the base-band signal and spreading its bandwidth over the original full voice terminal bandwidth (e.g. the telephone bandwidth). As already mentioned, should a tone, at a frequency higher than the low pass cut-off frequency be embedded in the original voice terminal bandwidth, then said tone would be lost.

Figure 1:
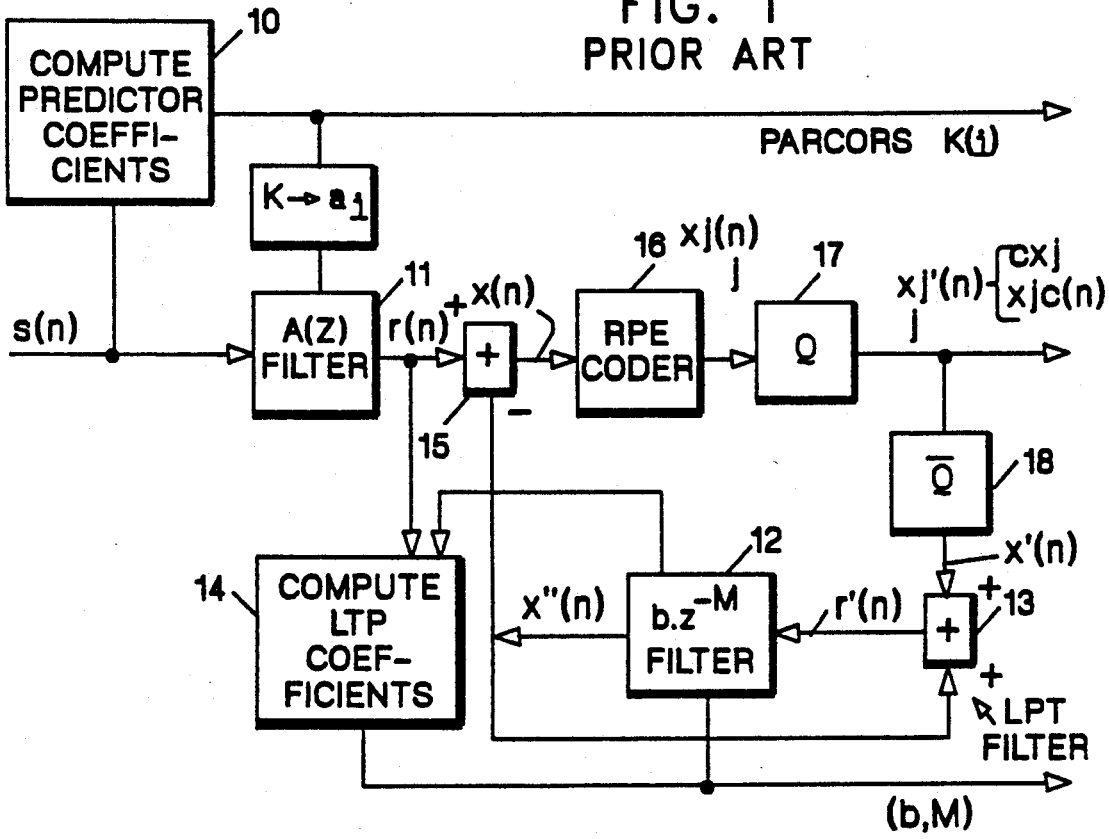
FIG. 1 PRIOR ART
FIGS. 1 and 2, respectively represent block diagrams of a prior art coder and decoder wherein the invention is to be implemented.

A block diagram of the RPE/LTP coder known in the Art, is represented in FIG. 1. The original signal s(n) sampled at 8 kHz and PCM encoded, is provided by a voice terminal (e.g. a telephone set not shown) limiting the bandwidth to 300–3300 Hz. The s(n) signal is analyzed by short-term prediction in a device (10) computing so called partial correlation (parcor) related coefficients. s(n) is filtered by an optimal predictor filter A(z) (11) whose coefficients are provided by computing device (10). The resulting residual signal r(n) is then analyzed by Long Term Prediction (LTP) into an LTP filter loop including a filter (12) with a transfer function $b.z.^{-M}$ in the z domain, and an adder (13). b and M are respectively, a gain coefficient and a pitch related coefficient. Both b and M are computed in a device (14), an efficient implementation of which has been described in copending European Application 87430006.4. The M value is a pitch harmonic selected to be larger than 40 r(n) sample intervals. The LTP loop is used to generate an estimated residual signal x''(n) to be subtracted from the input residual r(n) into a device (15) providing an error residual signal x(n).

RPE coding operations are performed in a device (16) over fixed length consecutive blocks of samples (e.g. 40 ms or 5 ms long) of said signal x(n). Conventionally, said RPE coding involves converting each x(n) sequence into a lower rate sequence of regularly spaced samples. The x(n) signal is, to that end, Low Pass filtered into a signal y(n) and then split into at least two down sampled sequences x1(n) and x2(n). Typical toll quality RPE operating at 12–16 kbps considers for each low-pass filtered 40 ms sequence of residual samples (x(n); n=0, . . . , 19), the selection of one out of two sub-sequences:

$$x1(n)=y(2n)\ n=0,\ldots,19.$$

$$x2(n)=y(2n+1)\ n=0,\ldots,19.$$

The sub-sequence selection is made on the basis of an energy criterium, according to:

$$E(i) = \underset{n=0}{\overset{19}{SUM}}(xi(n))^2 \text{ for } i = 1,2$$

select $j$ such that $$E(j) = \underset{i=1}{\overset{2}{MAX}}E(i)$$

The sub-sequence xj(n) with the highest energy is supposed to best represent the x(n) signal. The samples of the selected sequence are quantized in (17) using Block Companded PCM (BCPCM) techniques, quantizing each selected block of samples xj(n) into a characteristic term cxj and a sequence of quantized values xjc(n). Naturally the grid reference j is also used to define the selected RPE sequence, by representing a table address reference.

The selected sequence is also dequantized in a device $\overline{Q}$ (18), prior to being fed into the LTP filter loop reconstructing a synthesized sequence x''(n) to be substracted in (15) from r(n) and generate the x(n) signal.

Consequently, the coder output consists in a set of parcor coefficients K(i) describing the locutor's vocal tract, a set of LTP coefficients (b, M), and the grid number j associated with the selected quantized sub-sequence xj'(n) including at least one cxj value and a set of xjc(n) of binary values.

Figure 2:
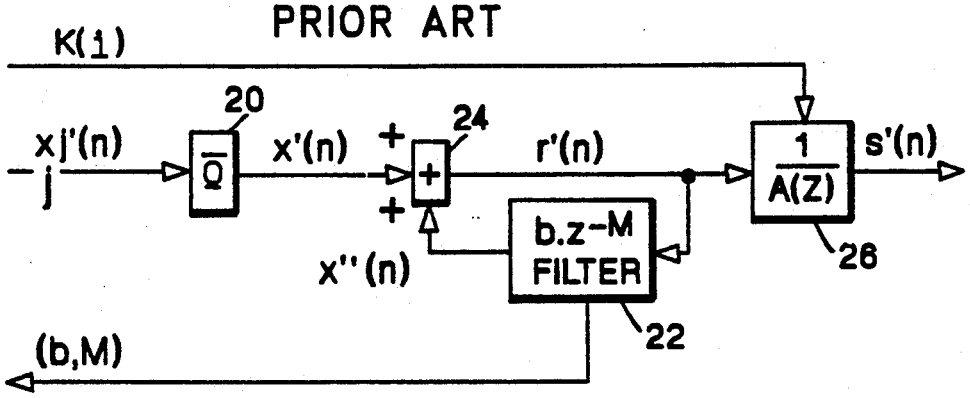
FIG. 2 PRIOR ART

Represented in FIG. 2 is a simplified block diagram for decoding operations. First xj'(n) and j are fed into dequantizer (20) providing an up sampled synthesized residual error, x'(n) signal sequence. Said error signal x'(n) is fed into an LTP filter loop including a filter with transfer function, $b.z^{-M}$ adjusted by the (b, M) coefficients and an adder (24), and providing a Long Term synthesized residual signal r'(n), fed into a short term filter (26) with transfer function 1/A(z). Finally, a synthesized voice signal s'(n) is available at the output of filter (26).

Figure 3:
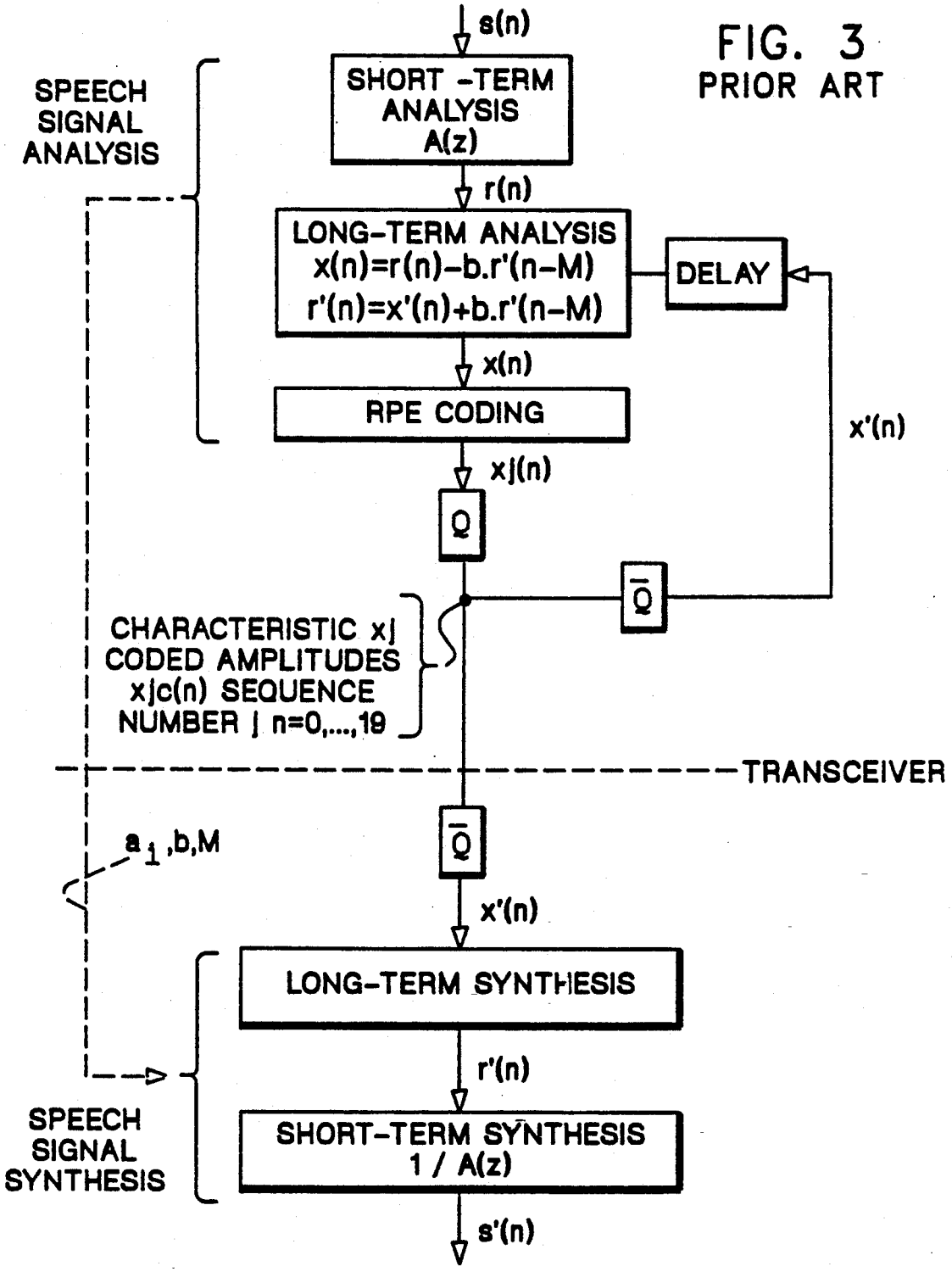
FIG. 3 PRIOR ART

Represented in FIG. 3 is a simplified flow chart of the speech signal analysis and synthesis operations as involved in a transceiver (coder-decoder). Said flow chart is self explanatory when considered in conjunction with FIGS. 1 and 2, given the following additional information:

x''(n)=b.r'(n−M)

parcor coefficients K(i) are converted into a(i) prior to being used to tune the filters A(z) and 1/A(z).

a delay line is inserted in the LTP Filter loop.

The operations involved ahead of the RPE coding and represented in the two upper blocks of FIG. 3 are further detailed in the flow-chart of FIG. 4. As disclosed in FIG. 4 the short term analysis enables deriving the residual signal $$r(n) = s(n) - \sum_{i=1}^{i=8} a_i \cdot s(n-i)$$

Derivation of parcor related a(i) coefficients is further emphasized in the flow-chart of FIG. 5. The a(i)'s are derived by a step-up operation procedure from the so-called parcor coefficients, using a conventional Leroux-Guegen method. The K(i) coefficients may be coded with 28 bits using the Un/Yang algorithm. For details on these methods and algorithms, one may refer to:

J. Leroux and C. Guegen: "A fixed point computation of partial correlation coefficients" IEEE Transactions on ASSP, pp. 257–259, June 1977.

C. K. Un and S. C. Yang "Piecewise linear quantization of LPC reflexion coefficients" Proc. Int. Conf. on ASSP Hartford, May 1977.

J. D. Markel and A. H. Gray: "Linear prediction of speech" Springer Verlag 1976, Step-up procedure, pp. 94–95.

European Patent 0,002,998 (U.S. Counterpart U.S. Pat. No. 4,216,354).

The short-term filter (13) derives the short-term residual signal samples:

$$r(n) = s(n) - \sum_{i=1}^{i=8} a_i \cdot s(n-i)$$

Figure 6:
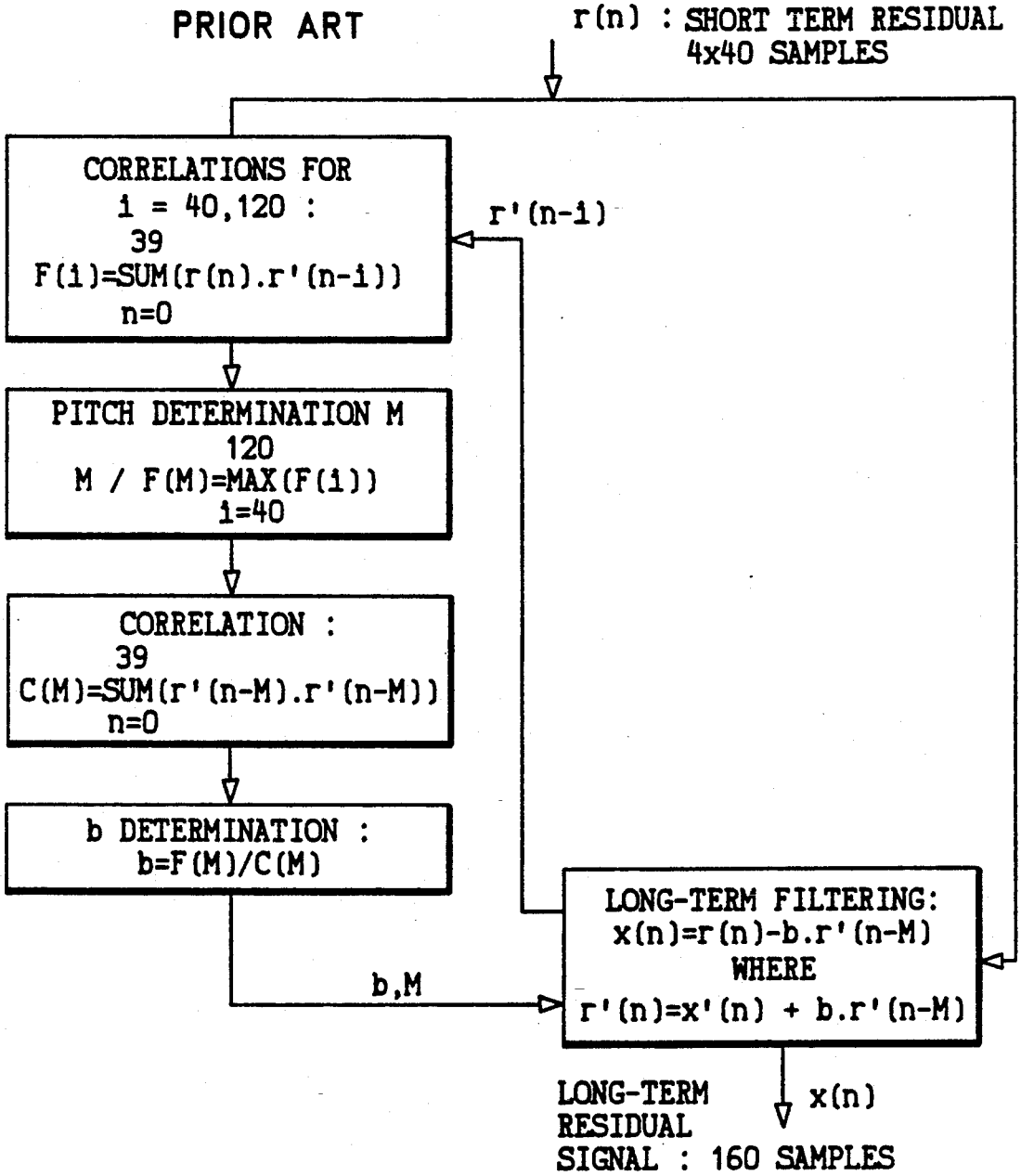
FIG. 6 PRIOR ART

FIG. 6 is a flow-chart summarizing the r(n) to x(n) conversion. It should be noted that these operations are performed over sequenced of 160 samples representing four blocks of fourty samples. Assuming current block of samples is time referenced from n=0 to n=39, correlations are operated from i=40 to 120 over r(n) and r'(n−i) to derive:

$$F(i) = \underset{n=0}{\overset{39}{SUM}}(r(n) \cdot r'(n-i)). \text{ for } i = 40, 41, \ldots, 120$$

One may, in theory, extend i up to 160. It has been found that, given conventional pitch values, a limitation to the $120^{th}$ sample position was sufficient, which not only saves computing workload but also saves on the number of bits to be used to code the pitch related value M.

Next operation involves detecting the $i^{th}$ sample location providing the highest $F_{(i)}$ value, which location corresponds to the M pitch related data looked for.

Auto correlation operations are then performed over r'(n−M) for n varying from 0 to 39 to derive a C(M) (see FIG. 6) value therefrom and subsequently enable computing $$b = F(M)/C(M)$$

Both RPE and RPE/LTP coder well apply to speech signals encoding because RPE low-pass filtering may be made to have a cut-off frequency at fs/4 (where fs represents the sampling frequency). Synthesis up-sampling achieved through insertions of zero valued samples is equivalent to a signal up sampling and harmonic generation by frequency folding which well applies to typical voiced signals.

However, as far as non-speech signals are concerned, the harmonic folding, forbid getting a correct reconstruction of signals having a significant spectrum density outside the frequency range covered by the low-pass filter.

Figure 7A:
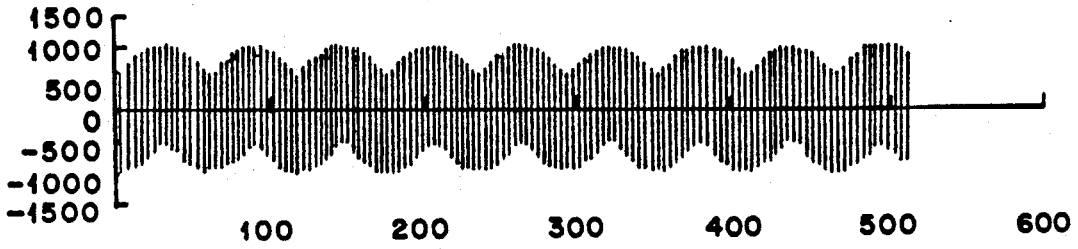
FIGS. 7-8 are made to illustrate the problem to be solved by this invention.
Figure 7B:
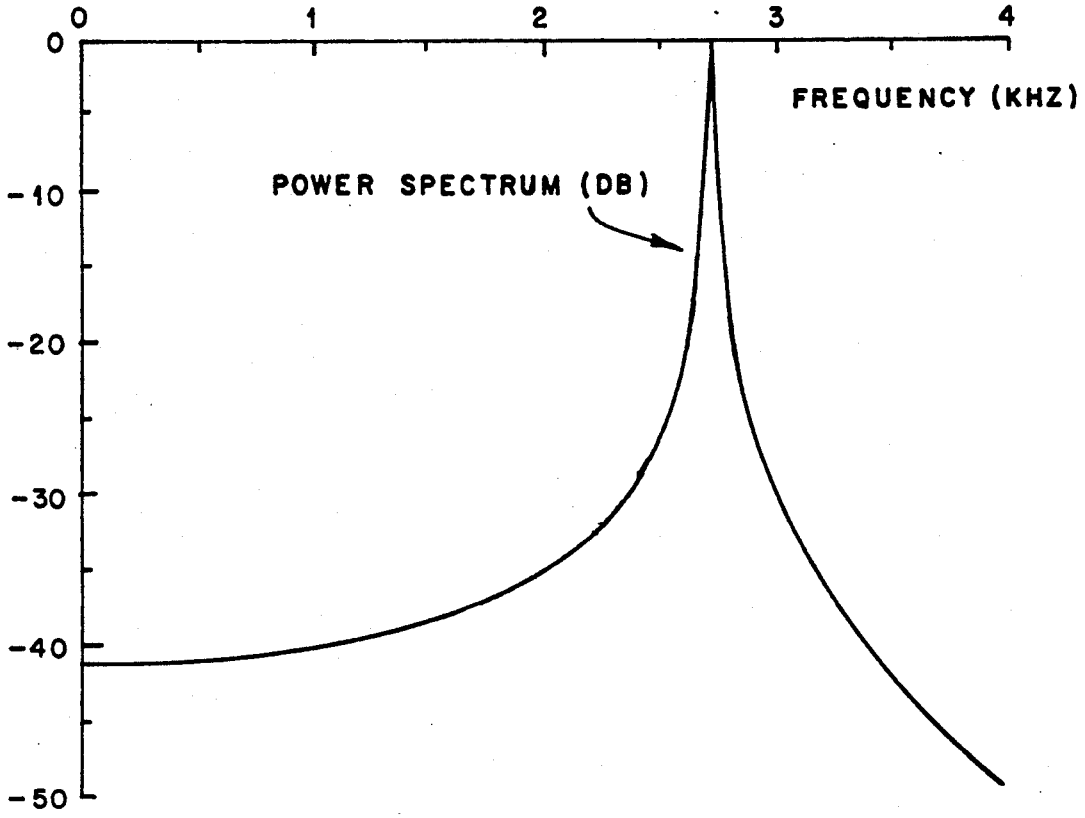
Figure 8A:
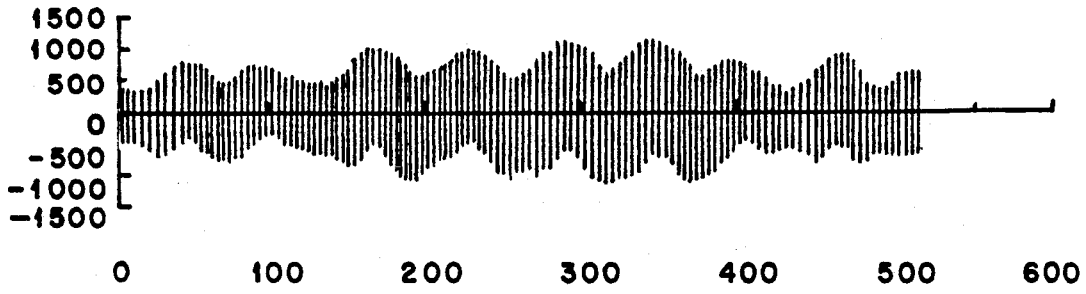
Figure 8B:
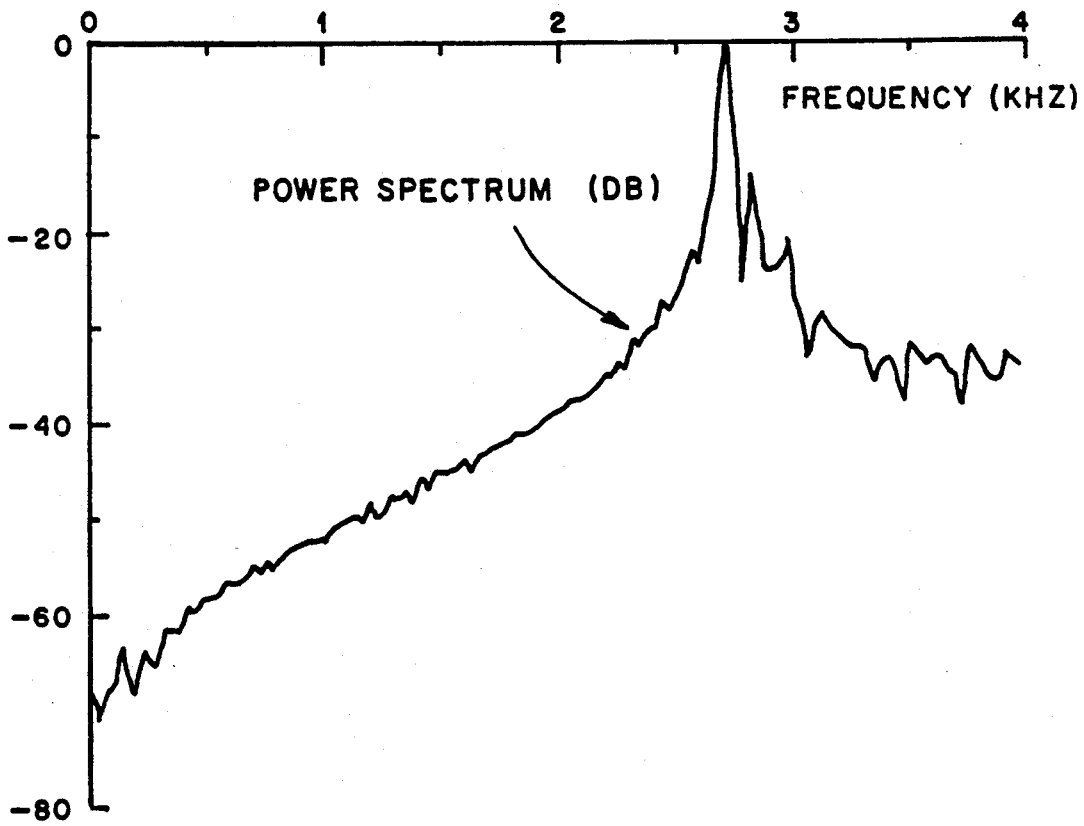

FIGS. 7 and 8 show the time waveform and the power spectrum of a tone at 2.7 kHz as it appears prior to being encoded with RPE/LTP (FIG. 7), and after said encoding (FIG. 8) when designed for an operation at 16 kps with a ½ decimation filtering. One may notice the distortions operated over the coded tone, which distortions may forbid the tone from being detectable from the coded signal, without any ambiguity.

In summary, base band coding enables low rate coding to be achieved through limitation of the bandwidth of the original voice signal to a low frequency bandwidth, down sampling the contents of said limited bandwidth and coding said down sampled contents, while deriving also from the original signal, predefined parameters, whereby synthesis would by achieved by spreading the limited band back to original bandwidth.

As was made apparent from the above description the process may affect and distort tones embedded within the original bandwidth.

This invention enables overcoming these drawbacks by splitting the original signal bandwidth, into at least two bandwidths, down sampling each sub-band contents, and then selecting the down sampled sub-band signal closest to the original, to be representative of the band limited signal whose samples are to be encoded.

Figure 9:
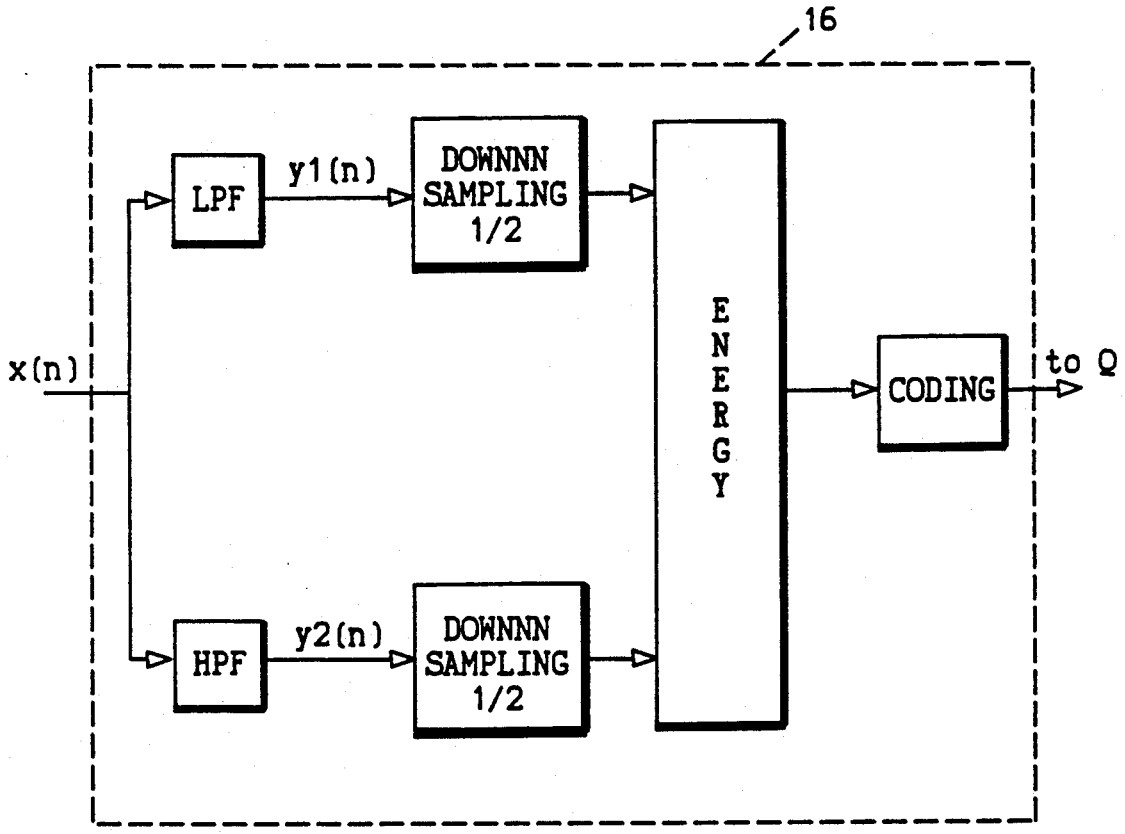
FIGS. 9-10 and 14 are block diagrams illustrating the invention.

The process may be achieved by operating the RPE coding operation of device (16) of FIG. 1, into an improved device as represented in FIG. 9. In this case, the voice terminal derived signal x(n) is split into a low frequency (LPF) bandwidth and a high frequency (HPF) bandwidth, whose contents are sub-sampled to ½ the original sampling rate. Then the respective sub-band energies are computed for each 5 millisecond (ms) block and the sub-band with highest energy is encoded to be representative of x(n).

The system is further improved by noting that the closest the finally synthesized signal s'(n) is from the original signal s(n), the better the system. In other words:

$$ei(n) = s(n) - s'(n)$$

should be minimized.

In other words, assuming each sub-band contents be half rated through RPE coding, the optimal RPE selection criteria would then better be based on:

$$\underset{i=1}{\overset{4}{Min}}\left[E(i) = \underset{n=0}{\overset{39}{SUM}}(ei(n))^2\right]$$

When expressing all time referenced data in the z domain by capital letters, e.g. accordingly S(z) and S'(z) corresponding to s(n) and s'(n) respectively, one may note that:

$$S(z) = \frac{1}{A(z)} R(z)$$

$$S'(z) = \frac{1}{A(z)} R'(z)$$

$$= \frac{1}{A(z)} [X'(z) + X''(z)]$$

$$= \frac{1}{A(z)} [X'(z) + b \cdot z^{-M} R'(z)]$$

$$E(z) = S(z) - S'(z)$$

$$= \frac{1}{A(z)} R(z) - \frac{1}{A(z)} [X'(z) + X''(z)]$$

$$= \frac{1}{A(z)} [R(z) - X'(z) - X''(z)]$$

$$= \frac{1}{A(z)} \cdot D(z) \text{ with } D(z) = X(z) - X'(z)$$

Therefore, optimal selection criteria could be achieved by using grid selection based on considering the following coding error data d(n)

$$d(n) = x(n) - x'(n)$$

leading to an optimal analysis by synthesis method.

Figure 10:
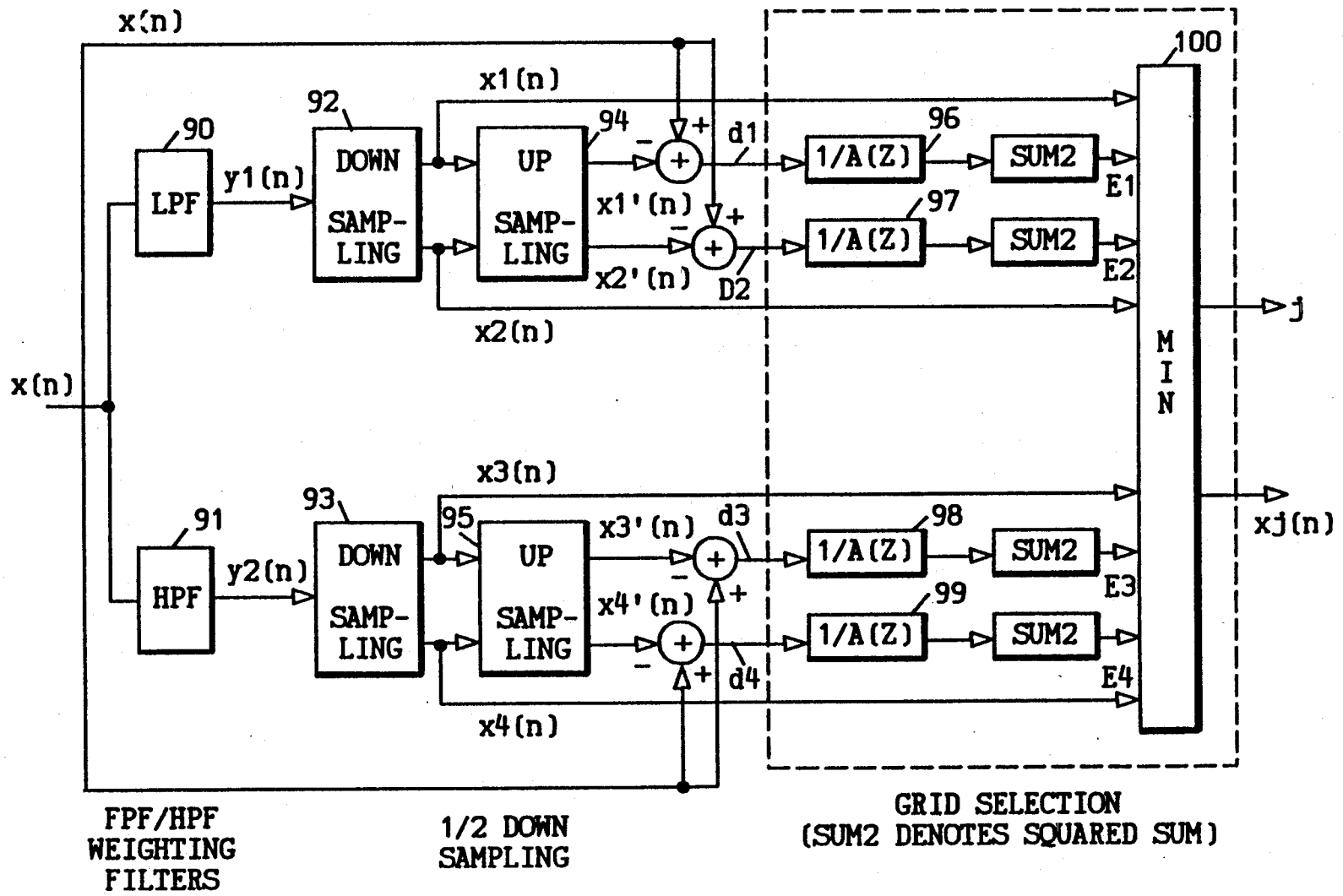

Represented in FIG. 10 is a detailed representation of the RPE Coder to be used to replace the device (16) of FIG. 1, to enable proper RPE/LTP coding to be performed whereby tones detection is adequately achievable.

The x(n) signal provided by adder (15) is fed into both a low-pass filter (LPF) (90) and a high-pass filter HPF (91) providing a low-pass filtered signal y1(n) and a high-pass filtered signal y2(n), respectively. The y1(n) is split into two half-sampled signals x1(n) and x2(n), while y2(n) is similarly split into x3(n) and x4(n) in down sampling devices 92 and 93.

The four down sampled signals are converted back to their original sampling rate through up-sampling operations operated in devices 94 and 95, providing signals x1'(n), x2'(n), x3'(n) and x4'(n), which are in turn subtracted from x(n) to derive error d1(n), d2(n), d3(n) and d4(n) therefrom.

Said error signals are filtered into inverse short term filters 1/A(z), whose outputs are squared and summed over a block period to derive energy data Ej, for j=1,2,3,4.

Finally the RPE sequence xj(n) to be selected in 100, and quantized, is the one minimizing Ej.

Figure 11:
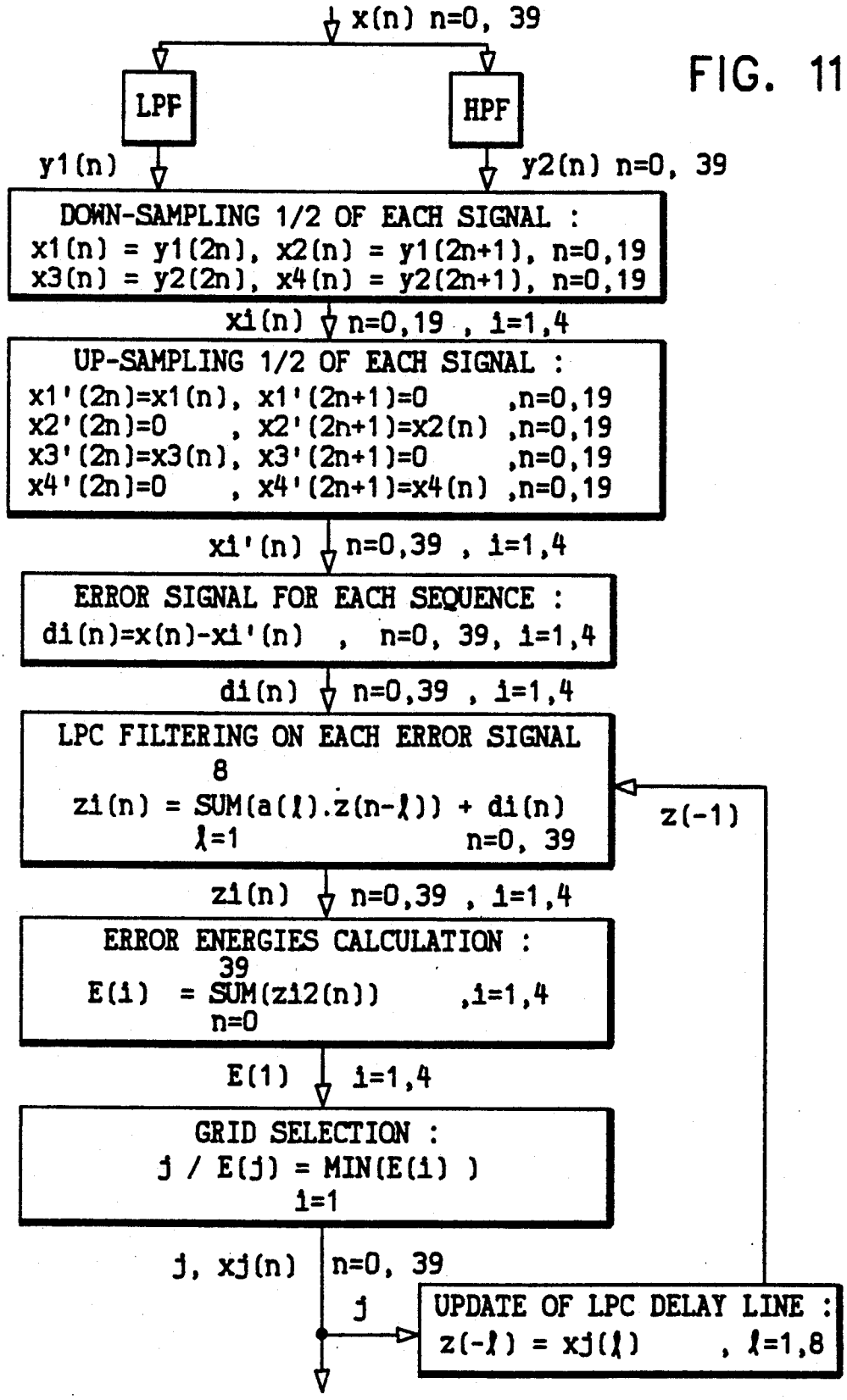
FIGS. 11-12 are flow chart for achieving the invention.

Represented in FIG. 11 is a flow-chart summarizing the above mentioned improved RPE operations. Each block of fourty samples of filtered signals y1(n) and y2(n) is down sampled according to:

$$x1(n)=y1(2n)$$

$$x2(n)=y1(2n+1)$$

$$x3(n)=y2(2n)$$

$$x4(n)=y2(2n+1)$$

for n=0, 1, . . . , 19.

Upsampling back to original sampling rate is achieved by inserting zero valued sampled in-between each couple of consecutive samples of the sequences x1(n), x2(n), x3(n) and x4(n) properly phased, to derive x1'(n) through x4'(n).

The error signal sequences di(n) are then derived according to:

$$di(n)=x(n)-xi'(n)$$

for i=1, . . . , 4 and n=0, . . . , 39.

The filtering operations of devices 96 through 98 are performed using the eight parcor related coefficients a(l) for l=1, 2, . . . , 8, according to:

$$zi(n) = \underset{l=1}{\overset{8}{SUM}}(a(l) \cdot z(n-1)) + di(n)$$

$$\text{for } i = 1, \ldots, 4 \quad n = 0, \ldots, 39$$

Error energy operations are performed in the devices designated SUM2 in FIG. 10 to derive:

$$E(j) = \underset{n=0}{\overset{39}{SUM}}(zj^2(n))$$

$$\text{for } j = 1, \ldots, 4.$$

Then the grid selection made to designate the xj(n) sequence to be selected as representative of the RPE coded x(n) sequence is based on minimal energy E(i) consideration.

It should also be noted that the xj(n) samples are fed back into an eight samples long shift register, used for performing the 1/A(z) filtering operations of devices 96 through 99.

The block of fourty xj(n) for n=0, . . . , 39 are BCPCM coded into at least one characteristic term (e.g. largest sample) per block and fourty binary values xjc(n) for n=0, . . . , 39 coding the fourty samples normalized to the characteristic term value. For further details on BCPCM one may refer to A. Croisier, "Progress in PCM and Delta modulation: Block companded coding of speech signals", 1974, International Zurich Seminar.

Figure 12:
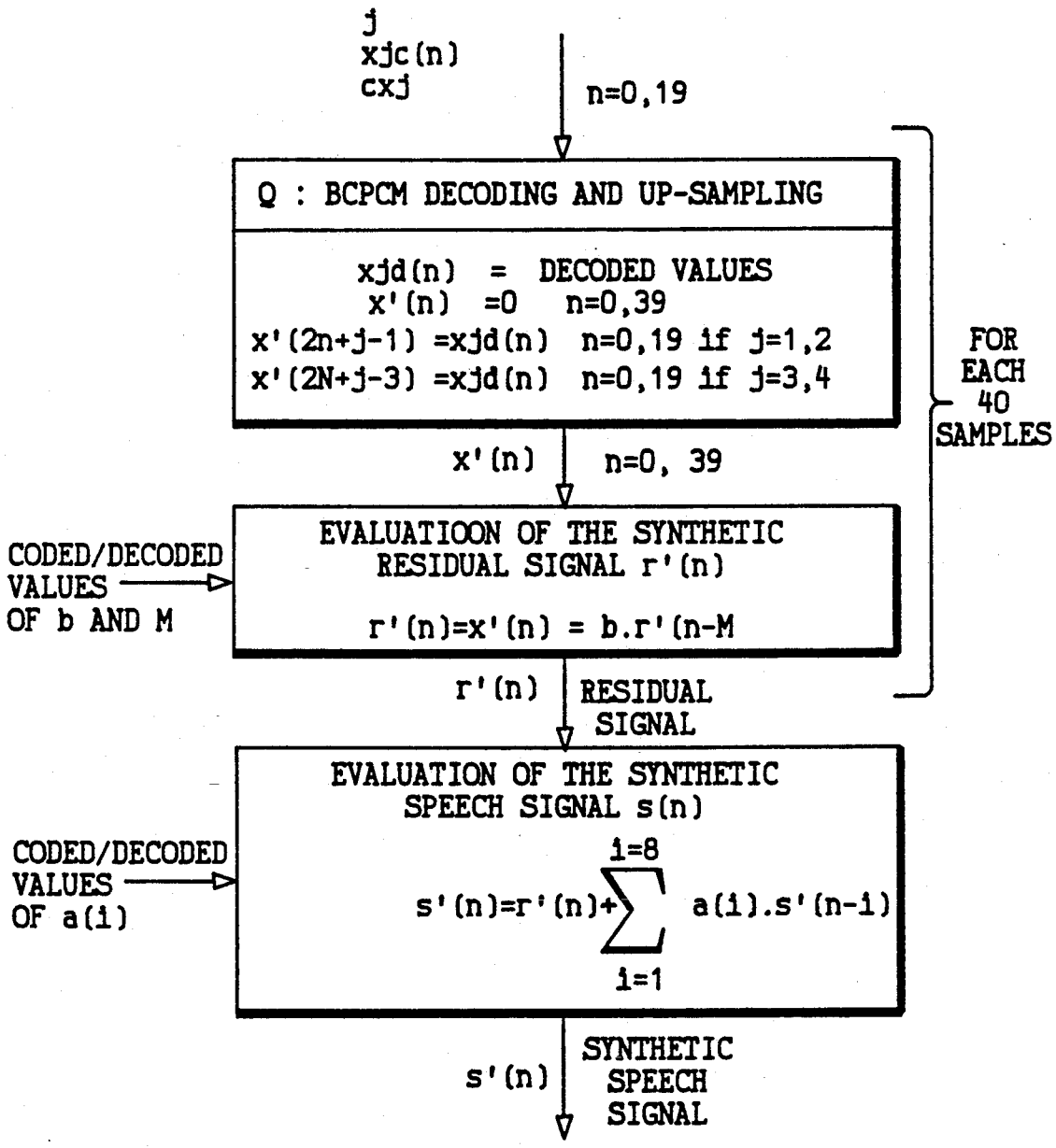

The operations for subsequent decoding to optimally convert the signal back to an optimal representation s'(n) of s(n) with xjd(n) representing decoded values, is represented in the flow-chart of FIG. 12. For each block of samples, conventional BCPCM implies using the characteristic term cxj for converting the samples xjc(n) back to their original value. RPE decoding involves up-sampling back to the sampling rate of the RPE coder input signal.

This should be combined with taking also into consideration the dynamic selection among either one of the high and low frequency bandwidth as achieved at the coder level within devices 90 and 91.

Finally, one gets sequences of fourty dequantized values x'(n) to be converted into a residual signal $$r'(n)=x'(n)+br'(n-M).$$

Said residual signal is then filtered back to the speech signal $$s'(n) = r'(n) + \sum_{i=1}^{8} a(i) \cdot s'(n-i)$$

Figure 13A:
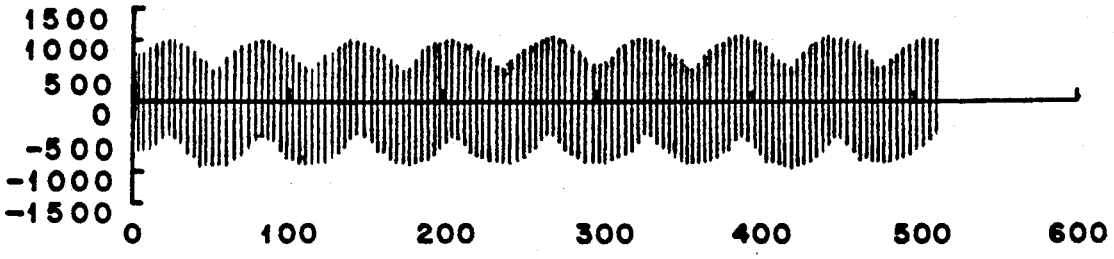
FIG. 13 illustrate the improvement provided by the invention.
Figure 13B:
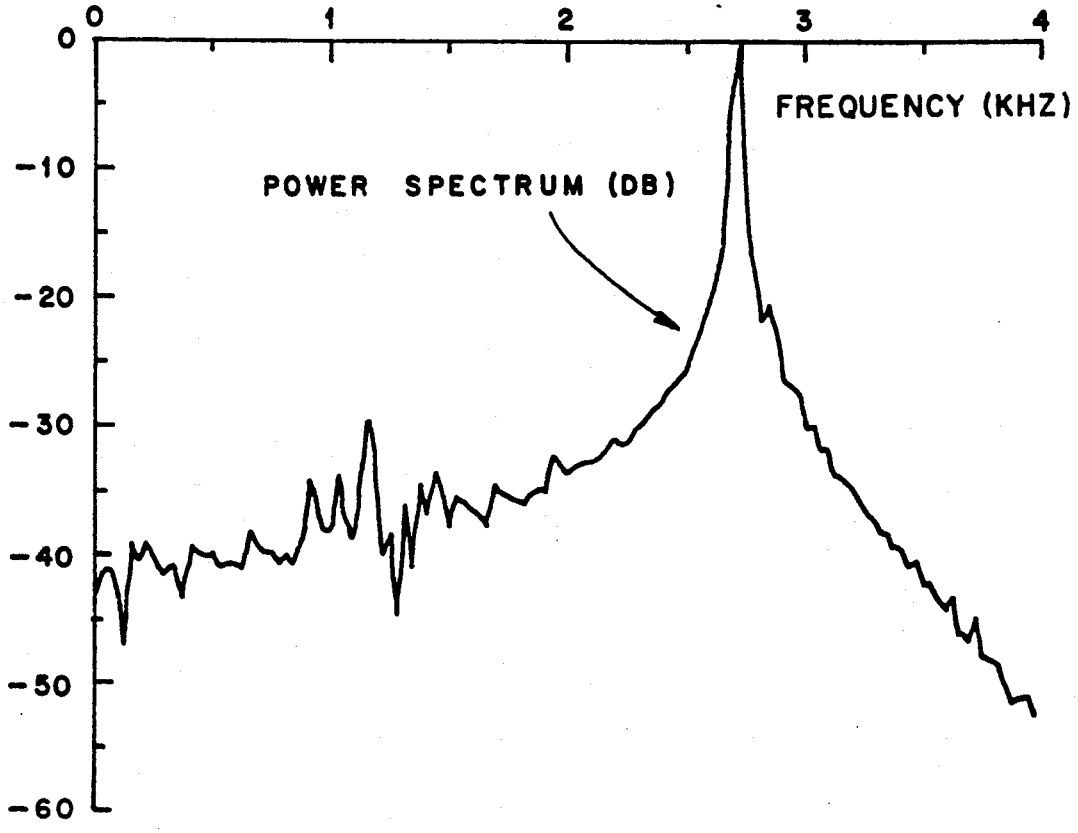

As represented in FIG. 13, one may notice the improvement over coding the above considered tone at 2.7 kHz. Not only the time varying representation of the decoded signal looks much cleaner, but same conclusions are made unquestionable when considering the power spectrum representation of the lower portion of FIG. 13.

Figure 14:
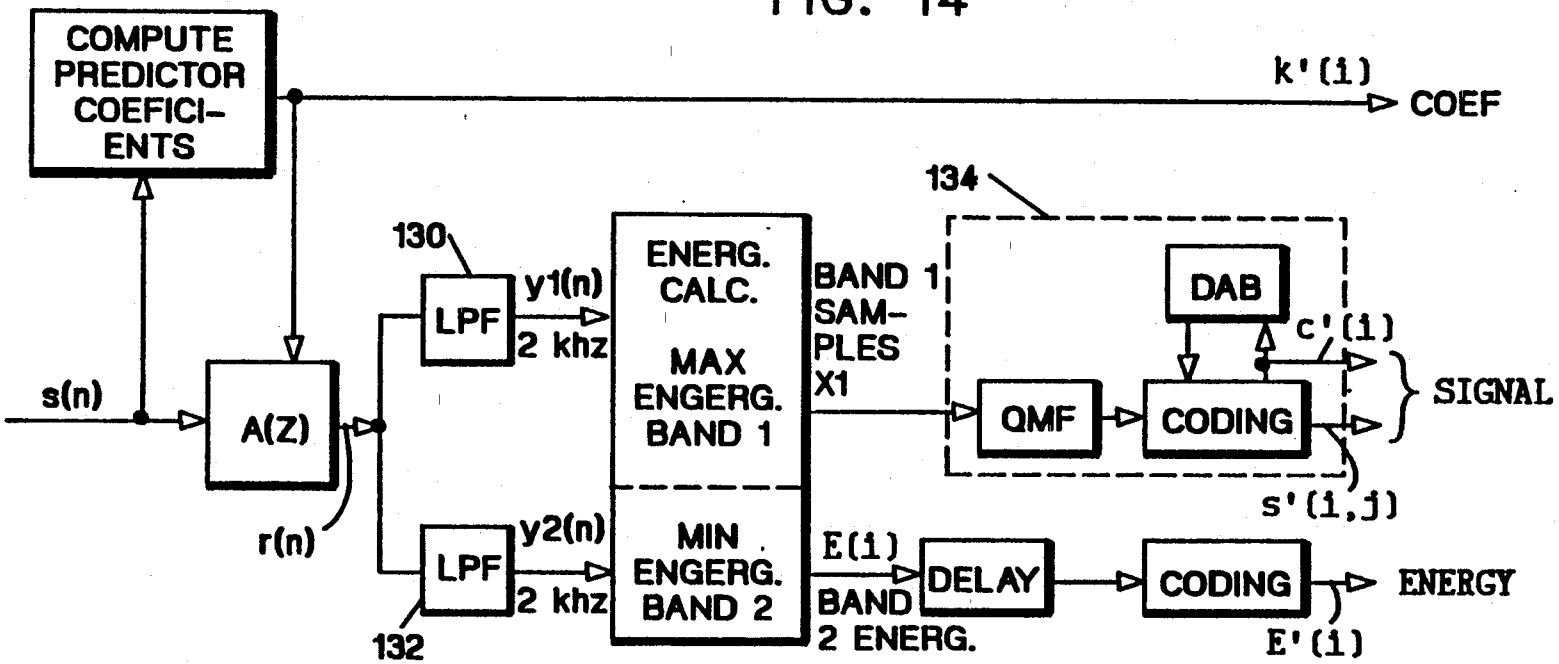

As already mentioned, the same approach to improve base band voice coders to enable efficiently coding tones, applies to different types of baseband voice coders, such as, for instance VEPC coders, as represented in FIG. 14.

The residual signal r(n) is split into two sub-bands, i.e. a low-frequency bandwidth and a high frequency bandwidth using filters (130) and (132) respectively. Both sub-band contents are down sampled and then processed by blocks of samples to derive therefrom energy indications.

For instance, sub-band energy indication may be gathered by summing the samples within a same block raised to the power two. Assume the highest energy sub-band be designated Band1, the lowest, Band2. Then recoding/quantizing would be operated in a device (134) over Band1, while energy coding/quantizing would be operated over Band2.

As disclosed in the above cited IBM Journal, said device (134) includes Quadrature Mirror Filters (QMF) splitting Band1 into several sub-bands, and then quantizing coding the sub-band contents by dynamically allocating the quantizing bits (DAB).

In other words, the function of the low (LPF) and high (HPF) frequency bandwidths cited in the IBM Journal would, here, be swapped dynamically based on the above mentioned energy criteria.

Finally, with both types of coders (VEPC, or RPE) low bit rate coding of a signal derived from a voice terminal is achieved, by splitting said derived signal into at least two sub-bands, and then selecting for further quantizing/coding the samples of the sub-band best matching the original voice terminal signal.

We claim:

1. A process for low-rate coding a base-band signal x(n) derived from a signal s(n) provided by a voice terminal and sampled at a first rate, said process including:

a) splitting the base-band signal frequency bandwidth into at least two sub-band signals;

b) sub-sampling each sub-band signal content to a lower rate than said first rate;

c) selecting the sub-sampled sub-band contents best matching the voice terminal signal as being representative of said voice terminal derived signal to be further encoded at low rate.

2. A process according to claim 1 wherein said selecting includes:

splitting each sub-sampled sub-band signal into fixed length blocks of samples;

measuring the energy content of each fixed length block of samples within each sub-sampled sub-band signal; and selecting the highest energy sub-band sub-sampled signal to be further encoded at a low rate.

3. A process according to claim 1 wherein said selecting includes:

up-sampling each sub-sampled sub-band signal back to said first rate;

subtracting each up-sampled sub-band signal from the original base band signal to derive a sub-band error signal therefrom; and selecting the sub-band signal presenting the lowest error signal for being representative of said voice terminal derived signal to be low-rate encoded.

4. A low rate voice coding device of the type wherein a voice signal s(n) sampled at a first rate, is decorrelated through a short-term filter into a residual signal r(n) further processed to derive therefrom an error residual signal x(n), which x(n) is then block coded into lower sampled sequences of samples with a Regular Pulse Excited (RPE) coder, the improvement whereby said RPE coder includes:

filtering means for filtering said x(n) signal into at least one low frequency band signal y1(n) and one high frequency band signal y2(n);

down sampling means for sub-sampling y1(n) and y2(n) each into at least two sub-sampled sequences (x1(n); x2(n)) and (x3(n); x4(n)) respectively;

up-sampling means for respectively up-sampling said sub-sampled sequences x1(n), x2(n), x3(n) and x4(n) into sequences x1'(n), x2'(n), x3'(n) and x4'(n) up-sampled back to said first rate;

coding error means for computing coding error data $$dj(n)=x(n)-xj'(n) \text{ for } j=1,\ldots,4$$

grid selection means for comparing said dj(n) to each other based on a mean squared criteria and deriving therefrom the xj(n) sequence representing the RPE encoded x(n).

5. A low rate voice coding device according to claim 4 wherein said grid selection means include:

inverse short-term filtering means;

means for feeding each said dj(n) data into said inverse filtering means;

summing means fed with said dj(n) and deriving error energy data Ej(n) therefrom whereby the RPE representative sequence would be selected for minimal Ej(n).

6. A device for improving a Voice Excited Predictive (VEPC) coder wherein the voice signal s(n) sampled at a first rate, is decorrelated into a residual signal r(n), said r(n) to be subsequently coded into a band energy data E(i) and a BCPCM coded SIGNAL data, the improvement including:

filtering means for filtering said r(n) signal into at least one low frequency signal sequence of samples y1(n) and one high frequency signal sequence y2(n);

sub-sampling means for lowering the y1(n), y2(n) sampling rate to half said first rate;

energy computing means for computing the energy within each said sub-sampled sequences; and selecting means for selecting the highest energy sequence to be representative of said SIGNAL data and be processed accordingly as the VEPC SIGNAL data, while said lowest energy sequence provide the VEPC Energy data.

* * * * *